United States Patent [19]

Jones, Jr. et al.

[11] 4,184,553

[45] Jan. 22, 1980

[54] METHOD FOR CONTROLLING DIRECTION OF HORIZONTAL BOREHOLE

[75] Inventors: Emrys H. Jones, Jr., Westover, W. Va.; Thomas R. Miller, Waynesburg, Pa.

[73] Assignee: Conoco, Inc., Ponca City, Okla.

[21] Appl. No.: 954,520

[22] Filed: Oct. 25, 1978

[51] Int. Cl.[2] ..... E21C 15/00; E21C 19/00

[52] U.S. Cl. ..... 175/61; 175/62

[58] Field of Search ..... 175/61, 62, 79, 45, 175/247, 320

[56] References Cited

U.S. PATENT DOCUMENTS

| | | | |
|---|---|---|---|
| 3,120,282 | 2/1964 | Pickard | 175/247 X |
| 3,823,787 | 7/1974 | Haworth et al. | 175/61 X |
| 4,108,256 | 8/1978 | Moore | 175/61 |

OTHER PUBLICATIONS

Bromell, "How You Can Lower Your Drilling Costs with a Planned Crooked Hole Program", *World Oil*, Dec. 1954, pp. 129-132, 134, 136.

Cervik et al., "Rotary Drilling Holes in Coalbeds for Degasification", Bureau of Mines, Report of Investigations 8097, published in 1975, 21 pages.

Wiley, "New 'Packed Hole' Tool Combats Hole Deviation", *Drilling*, Jun. 1965, pp. 62-65, 67, 68, 74, 75.

*Primary Examiner*—Stephen J. Novosad

*Attorney, Agent, or Firm*—Richard W. Collins

[57] ABSTRACT

A heavy cylinder having an axial flow passage is pumped down a rotary drill string to a position adjacent a drill bit to cause an in-seam horizontal drill to be guided in a downward direction. The cylinder can be removed with a latchable retrieval tool after the path of the borehole is sufficiently altered.

6 Claims, 3 Drawing Figures

METHOD FOR CONTROLLING DIRECTION OF HORIZONTAL BOREHOLE

BACKGROUND OF THE INVENTION

1. Field of the Invention

This invention relates to a method for drilling generally horizontal boreholes in a subterranean earth formation, and more particularly to a method of adjusting the trajectory of such a borehole to maintain same within a seam of coal or the like.

The use of rotary drilling to form long generally horizontal gas relief holes in coal beds is known in the art as a means for degasifying a coal bed in advance of mining. These gas relief holes are either vented or connected to a vacuum source to remove methane from a coal bed. The greatest problem encountered in drilling these gas relief holes is that of maintaining the bit trajectory within the coal seam such that the resulting holes are actually through the coal seam rather than through an overlying or underlying formation.

2. Description of the Prior Art

The state of the art to which the present invention pertains is set forth in detail in a *Bureau of Mines Report of Investigations* published in 1975 numbered 8097 and entitled "Rotary Drilling Holes in Coalbeds for Degasification" by Cervik et al, available in the U.S. Department of the Interior Library. That report describes the use of rotary drill bits attached to drill rods and maintained in a desired trajectory by a combination of bit thrust, rotational speed and drill rod centralizer spacing. That report further notes that locating a centralizer or stabilizer near the drill bit will cause a slight upward trajectory with proper drill thrust and bit rotational speed, and further notes that a downward trajectory can be obtained by locating a centralizer several meters behind the bit. However, relocating a centralizer to cause a change in bit trajectory has previously involved removal of the drill string from the borehole. Such a procedure is time-consuming and unproductive.

A sliding stabilizer assembly for controlling bit trajectory without the necessity of removing the drill string is described in U.S. application Ser. No. 796,093, filed May 12, 1977, and now U.S. Pat. No. 4,108,256.

There has been a continuing need, prior to the present invention, for an improved method for controlling the trajectory of horizontal gas relief holes in coal seams.

SUMMARY OF THE INVENTION

According to the present invention, the trajectory of a horizontal borehole is adjusted in a downward direction by pumping a heavy cylinder down through the drill string to a position adjacent the drill bit. The weight of the cylinder causes the bit to drill in a slightly downward direction.

After the borehole trajectory has been changed the desired amount, the cylinder is removed with a retrievable latching tool and normal drilling is resumed. The process may be repeated as necessary to maintain the borehole within a seam of coal.

DESCRIPTION OF THE PREFERRED EMBODIMENT

Figure 1:
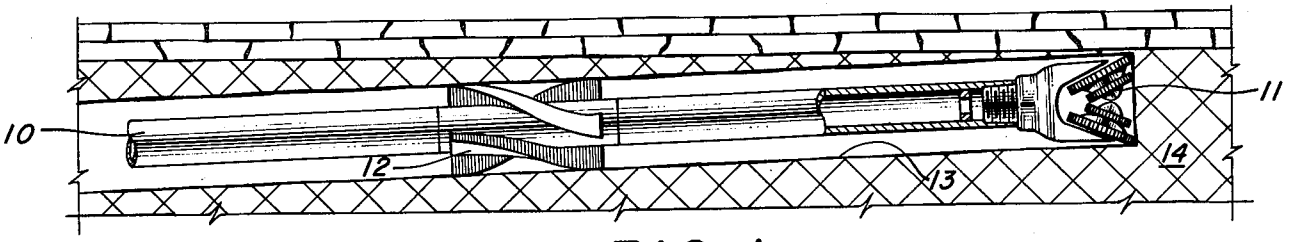
FIG. 1 is a view illustrating drilling of a borehole in a subterranean formation.

As seen in FIG. 1, a rotatable drill string 10 is shown having a bit 11 on the end and having a centralizer 12 positioned to provide a slight upward trajectory to borehole 13 in coal seam 14 when proper thrust and rotational speed are utilized. This combination of drill string, centralizer and bit is conventional, and the proper thrust and rotational speed to provide a slight upward trajectory when centralizer 12 is positioned relatively close to bit 11 is known to those skilled in the art as set forth in the aforementioned Bureau of Mines Report. As noted in the Bureau of Mines Report, the trajectory of a borehole has in the past been changed by removing the drill string, relocating the centralizer, and reinserting the drill string. The requirement for removing the drill string has resulted in costly delays in the operation, particularly when the borehole is several hundred meters into the coal bed.

A variety of retrievable instruments which can be pumped down the interior of the drill string are available which can provide information regarding borehole trajectory and/or proximity to an underlying or overlying formation, and the normal drilling procedure involves periodically stopping the drilling, pumping the instruments down the drill string, and determining whether a change in borehole trajectory is needed. If so, it has generally been necessary in the past to remove the entire drill string, relocate the centralizer on the drill string, and then reinsert the drill string and resume drilling. The present invention eliminates the need for removing the drill string to change the borehole trajectory.

Figure 2:
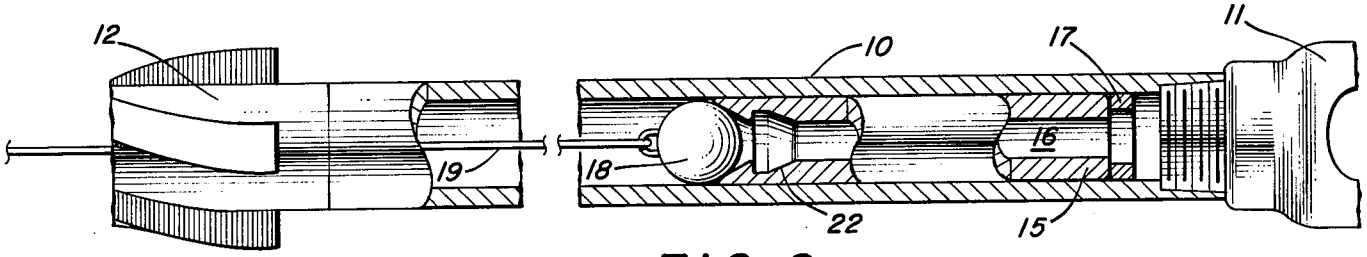
FIG. 2 illustrates a cylinder for adjusting the borehole trajectory in accordance with the invention.
Figure 3:
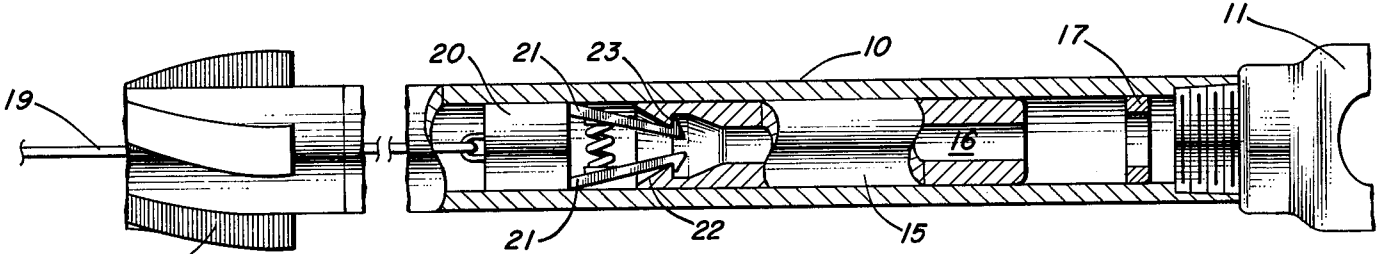
FIG. 3 illustrates equipment for removing the cylinder from a drill string.

The equipment used in carrying out the method of this invention is illustrated in FIGS. 2 and 3. In FIG. 2, a heavy cylinder 15 having an axial bore 16 therethrough is shown inside drill string 10. Cylinder 15 is positioned against stop member 17 on the interior of drill string 10 by inserting cylinder 15 at the opposite end of drill string 10, then inserting a pumpable ball 18 which seals against the angled surface 22 of cylinder 15 to close bore 16. Ball 18 is attached to a wireline 19 which is used to remove ball 18 after cylinder 15 is in place adjacent bit 11. Wireline 19 feeds through a packing device (not shown) as ball 18 and cylinder 16 are pumped down the drill string 10. After ball 18 is removed, drilling is resumed by applying appropriate thrust and rotation. During drilling, fluid is pumped down the inside of drill string 10, through bore 16 in cylinder 15, out through openings in bit 11, and finally back along the outside of drill string 10.

After drilling for a period of time with cylinder 15 in place as shown in FIG. 2, drilling is stopped and instruments are pumped down the drill string to determine the trajectory and/or proximity to an underlying or overlying formation. If the instruments indicate that the borehole should again have an upward trajectory, the cylinder 15 must be removed. This is accomplished by pumping a retrieval tool 20 (FIG. 3) down the drill string until latch members 21 contact angled surface 22 of cylinder 15 whereby latch members 21 are guided into cylinder 15. Latch members 21 then bear against shoulder 23 in cylinder 15 such that removal of retrieval tool 20 by rewinding wireline 19 will also effect removal of cylinder 15.

The cycle is then repeated, with cylinder 15 being periodically inserted and removed to control the trajectory of borehole 13.

It will be apparent to those skilled in the art that cylinder 15 is a relatively heavy, preferably metal, unit of appropriate dimensions to be easily pumpable down drill string 10 and of sufficient weight to cause the trajectory of borehole 13 to be adjusted downwardly. It will also be apparent that centralizer 12 is positioned so that appropriate thrust and rotational speed will cause a slight upward trajectory to borehole 13.

Numerous modifications and variations of the equipment described above could be utilized in carrying out the process of this invention.

We claim:

1. In a method of drilling a generally horizontal borehole in an underground formation wherein a rotary drill string with a drilling bit attached thereto is advanced into said formation, the improvement wherein the path of said borehole is adjusted in a downward direction by:

(a) running a cylinder having a fluid passage therethrough through the rotary drill string to a position in said drill string adjacent said bit; and (b) continuing drilling with said cylinder adjacent said bit whereby the weight of said cylinder causes the path of said borehole to be adjusted downwardly.

2. The method of claim 1 wherein, after the path of said borehole has been adjusted downwardly, said cylinder is removed from said drill string.

3. The method of claim 2 wherein said cylinder is removed by running a latchable retrieval tool down said drill string, latching said retrieval tool onto said cylinder, and removing said retrieval tool and cylinder from said drill string.

4. The process of claim 3 wherein said cylinder and said tool are moved through said drill string toward said bit by a pumped fluid.

5. The method of claim 4 wherein said borehole is formed in an underground coal seam.

6. The method of claim 4 wherein, after said path has been adjusted downwardly, said retrieval tool is removed by withdrawing a wireline attached thereto.

* * * * *